US009138124B2

(12) United States Patent
Lundberg et al.

(10) Patent No.: US 9,138,124 B2
(45) Date of Patent: Sep. 22, 2015

(54) TABLE TOP DISHWASHER

(75) Inventors: Mats Lundberg, Vallingby (SE); Luigi Salerno, Cinisello Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 128 days.

(21) Appl. No.: 13/814,374

(22) PCT Filed: Jul. 13, 2011
(Under 37 CFR 1.47)

(86) PCT No.: PCT/EP2011/003493

§ 371 (c)(1),
(2), (4) Date: Apr. 15, 2013

(87) PCT Pub. No.: WO2012/016632

PCT Pub. Date: Feb. 9, 2012

(65) Prior Publication Data

US 2013/0334940 A1 Dec. 19, 2013

(30) Foreign Application Priority Data

Aug. 6, 2010 (EP) ..... 10008217

(51) Int. Cl.
*A47L 15/42* (2006.01)
*A47L 15/00* (2006.01)

(52) U.S. Cl.
CPC ..... *A47L 15/4246* (2013.01); *A47L 15/0089* (2013.01); *A47L 15/4263* (2013.01)

(58) Field of Classification Search
CPC ..... A47L 15/00; A47L 15/42; A47L 15/4261; A47L 15/4257; A47L 15/4246; A47L 15/0089; A47L 15/4263
USPC ..... 134/56 D, 47; 277/306, 345, 348, 349, 277/350, 351, 352, 353, 362, 364, 368, 409, 277/604, 633
See application file for complete search history.

(56) References Cited

U.S. PATENT DOCUMENTS

| | | | | |
|---|---|---|---|---|
| 1,853,528 | A * | 4/1932 | Zademach | 220/252 |
| 2,063,746 | A | 12/1936 | Meeker | |
| 2,643,659 | A * | 6/1953 | Auten | 134/80 |
| 2,706,577 | A * | 4/1955 | Wolf | 220/378 |
| 2,824,567 | A * | 2/1958 | Karlstrom | 134/57 DL |

(Continued)

FOREIGN PATENT DOCUMENTS

| | | | |
|---|---|---|---|
| DE | 4438279 | A1 | 5/1996 |
| DE | 102004057019 | A1 | 6/2006 |

(Continued)

OTHER PUBLICATIONS

International Search Report for Application No. PCT/EP2011/003493 dated May 7, 2012.

*Primary Examiner* — Michael Barr
*Assistant Examiner* — Rita Adhlakha
(74) *Attorney, Agent, or Firm* — Alston & Bird LLP

(57) ABSTRACT

A table top dishwasher generally includes a tub and a water-tight hood located above the tub, the hood including a central region that includes a fixed portion which is joined to two side portions and a door which is rotatably connected to the side portions, the hood includes a sealing arrangement comprising curved side seals and curved abutment surfaces extending along the lateral edges of the door, wherein when the door is closed a contact pressure is exerted between the side seal and the abutment surfaces in a direction perpendicular to the axis of rotation of the door, wherein the radius of curvature of the side seals substantially corresponds to the radius of curvature of the abutment surfaces, and the center of curvature of the side seals is offset with respect to the center of curvature of the abutment surfaces.

14 Claims, 4 Drawing Sheets

(56) References Cited

U.S. PATENT DOCUMENTS

| | | | | |
|---|---|---|---|---|
| 3,460,878 | A * | 8/1969 | Peterson | 312/297 |
| 3,720,215 | A | 3/1973 | Haas | |
| 7,803,430 | B2 | 9/2010 | Krumme | |

FOREIGN PATENT DOCUMENTS

| | | | |
|---|---|---|---|
| EP | 0709055 | A1 | 5/1996 |
| EP | 1229866 | A1 | 8/2002 |
| EP | 2184000 | A1 | 5/2010 |
| GB | 301 268 | A | 11/1928 |
| WO | WO-0134121 | A2 | 5/2001 |
| WO | WO-2010/052021 | A1 | 5/2010 |
| WO | WO-2011/015313 | A1 | 2/2011 |
| WO | WO-2012/016631 | A2 | 2/2012 |
| WO | WO-2012/016710 | A2 | 2/2012 |

* cited by examiner

TABLE TOP DISHWASHER

CROSS REFERENCE TO RELATED APPLICATIONS

This application is a national stage application filed under 35 U.S.C. 371 of International Application No. PCT/EP2011/003493, filed Jul. 13, 2011, which claims priority from European Patent Application No. 10008217.1, filed Aug. 6, 2010, each of which is incorporated by reference herein in its entirety.

The present invention relates to a table top dishwasher, i.e. to a compact dishwasher, which in contrast to common built-in devices, is designed to be placed on top of a kitchen worktop or which can be used as a portable device.

The present invention particularly is concerned with table top dishwashers having a tub and a water-tight hood, wherein the hood comprises two fixed side portions and a curved central region having generally the shape of a cylinder shell, and wherein the central region comprises a fixed portion joined to the side portions and a rotatable door connected to the side portions.

It is an object of the present invention to provide for a table top dishwasher of the afore-mentioned type, which has a compact construction and which yet provides for a reliable and comfortable operation.

It is a particular object of the present invention to provide for a table top dishwasher of the afore-mentioned type, in which there is provided for a reliable sealing between the rotatable door and the fixed portions of the water-tight hood, wherein the sealing is exposed to little wear during continued operation of the dishwasher.

In conformity with the present invention the above object is solved by a table top dishwasher as it is defined in claim 1.

In the table top dishwasher suggested herein the curvatures of the side seals and that of the abutment surfaces therefore substantially correspond in its radius of curvature so that the side seals and the abutment surfaces therefore provide for a continuous and sound contact in a direction perpendicular to the axis of rotation of the door when the door is closed, so as to provide for a reliable sealing along the lateral edges of the door, but wherein the center of curvature of the side seals is offset with respect to the center of curvature of the abutment surfaces. When rotating the door from the closed position towards the opened position, by the above measure the contact pressure on the seals is reduced or the contact between seal and abutment surface even is terminated. Thus it is effectively avoided that the side seals remain in contact under with their abutment surfaces over the whole range of travel of the rotating door, so that the wear of the side seals during continued operation of the table top dishwasher is substantially reduced.

Providing for an offset between the center of curvature of the side seals and the center of curvature of the abutment surfaces enables implementing a sealing arrangement for the door which provides for good sealing results when the door is closed and which at the same time provides for a rapid reduction of the contact forces on the side seals when the door is opened, so that a permanent and excessive wear of the seals is avoided.

The present invention is useful for any dishwasher having an at least partial cylindrical hood. With the tub forming a chord to the circular base of the cylinder shell when viewed in the axial direction of the cylindrical shape, varying the distance from the cylinder axis to the tub alters both the available floor space of the tub and the height of the available volume within the hood. While a generally half-cylindrical shell would provide for a maximum in tub floor space, it usually is preferred to select a hood design in which the axis of the cylindrical shape of the hood extends at a distance above the upper edge of the tub, for example at a distance which amounts to about ⅓ to ½ times the radius of the cylindrical hood.

Preferred embodiments of the present invention are defined in the dependent claims.

In particular, while the center of curvature of the side seals and the center of curvature of the abutment surfaces can be offset either in the vertical direction or the horizontal direction, or both in the vertical direction and in the horizontal direction, in preferred embodiments the center of curvature of the side seals and the center of curvature of the abutment surfaces are located at substantially the same vertical position but are offset in the horizontal direction. Such a design allows avoiding excessive wear of the side seals without increasing the height of the dishwasher.

The offset between the center of curvature of the side seals and the center of curvature of the abutment surfaces preferably is determined based on the contact pressure to be achieved between the seal and the abutment surface, which in turn depends on the geometry and material of the side seal. In most cases the center of curvature of the side seals is offset with respect to the center of curvature of the abutment surfaces by a distance of 2 to 10 mm, preferably of 4 to 8 mm, and most preferred of about 6 mm The contact pressure on the side seals upon displacing the door from its closed position towards its opened position can be further reduced when the curvature of the side seals and/or of the abutment surfaces is slightly non-circular, i.e. slightly changes along the length of the side seals. While the numerical amount of such change will be determined based on the contact pressure to be achieved over the range of travel of the rotating door, the rate of change in curvature, as it can be expressed as the ratio of the radius of curvature at one end of the side seal and the radius of curvature at the other end of the side seal preferably is in the range of from 0.9 to 1.1, more preferred from 0.95 to 1.05.

By selecting for a suitable offset of the center of curvature of the side seals with respect to the center of curvature of the abutment surfaces and optionally by providing for a slightly non-circular design of the side seals, of the abutment surfaces or of both, such as for a design in which the side seals and/or the abutment surfaces have a curvature which gradually increases along their length, sealing arrangements can be implemented wherein the side seals come free from its respective abutment surfaces already after a relatively small rotation of the door, such as a rotation of only from 10 to 15 degrees.

Preferably, the rotatable door in its opened position is located below the fixed portion of the central region of the hood, so that water which has accumulated on the interior face of the door can drip off into the tub irrespective of whether the door is in the closed position or in any opened position. Escape of cleaning liquid to the exterior of the dishwasher thus is prevented.

While the side seals could be attached to the rotatable door so as to engage an abutment surface that is provided at the fixed side portions of the hood, it is preferred that the side seals are attached to the fixed side portions of the hood, so as to engage an abutment surface that is provided at the rotatable door. In such embodiments the abutment surfaces can be provided at the exterior of the door, so as to be contacted by the side seals from above Alternatively, the seal could be provided at the fixed side portions of the hood so as to provide a seal at the interior side of the door, wherein the abutment surfaces can be constituted by the interior side of the door.

The door can comprise a stepped recess which extends along the lateral edge of the door, wherein the floor of the recess constitutes the abutment surface. The stepped recess impedes water from escaping from the sealing area. Thus, when the seal, upon rotation of the door towards the fully opened position, looses contact with its abutment surface, water that may be present in the region of the recess will flow along the recess rather than escaping the recess.

In embodiments wherein the abutment surfaces are provided at the exterior side of the door, the side seals can be substantially circular, wherein the radius of curvature of the door increases from the lower edge of the door towards the upper edge of the door. Thus, the radius of curvature of the door when measured at the upper edge of the door is larger than the radius of curvature of the door measured at the lower edge of the door. It should be noted that instead of designing the door as such to be non-circular, the door also could be circular but be provided with non-circular abutment surfaces that extent along the lateral edges of the door.

In order to prevent that the seal does engage the abutment surface with insufficient contact pressure when the door is closed, the increase in curvature should be limited, for example to 10%, wherein values of 2% to 5% have proven to provide for a good comprise, on the one hand, in securing good sealing characteristics and, on the other hand, in causing the abutment surface to sufficiently move away from the sealing surface so as to keep the wear of the seal at a minimum.

Instead of employing circular side seals in combination with a slightly non-circular door, the door could be designed to be circular and the side seals could be designed to be slightly non-circular. Of course, also both components could be designed to be slightly non-circular.

In order to maximize the access area provided by the rotatable door, the fixed portion of the central region of the hood preferably spans about half of the circumference of the hood.

To prevent water from escaping the interior of the hood along either one of the bottom and top edges of the door, the dishwasher preferably comprises a top seal and a bottom seal.

In particular, in preferred embodiments a top seal is provided at one of the front edge of the fixed portion and the top edge of the door, wherein the other of these components comprises a top seal abutment surface which extends between the fixed portion and the door. In this manner a substantially radial abutment surface is formed between the hood fixed portion and the door.

In preferred embodiments there further is provided a bottom seal at one of the upper front edge of the tub and the bottom edge of the door, wherein the other one of these components comprises a bottom seal abutment surface which extends between the tub and the door. Also the bottom seal abutment surface preferably extends substantially radially, so that rotation of the door provides for the required contact pressure for efficiently sealing the bottom edge of the door.

Preferred embodiments of the present invention will be described below by reference to the drawings, in which.

Figure 1:
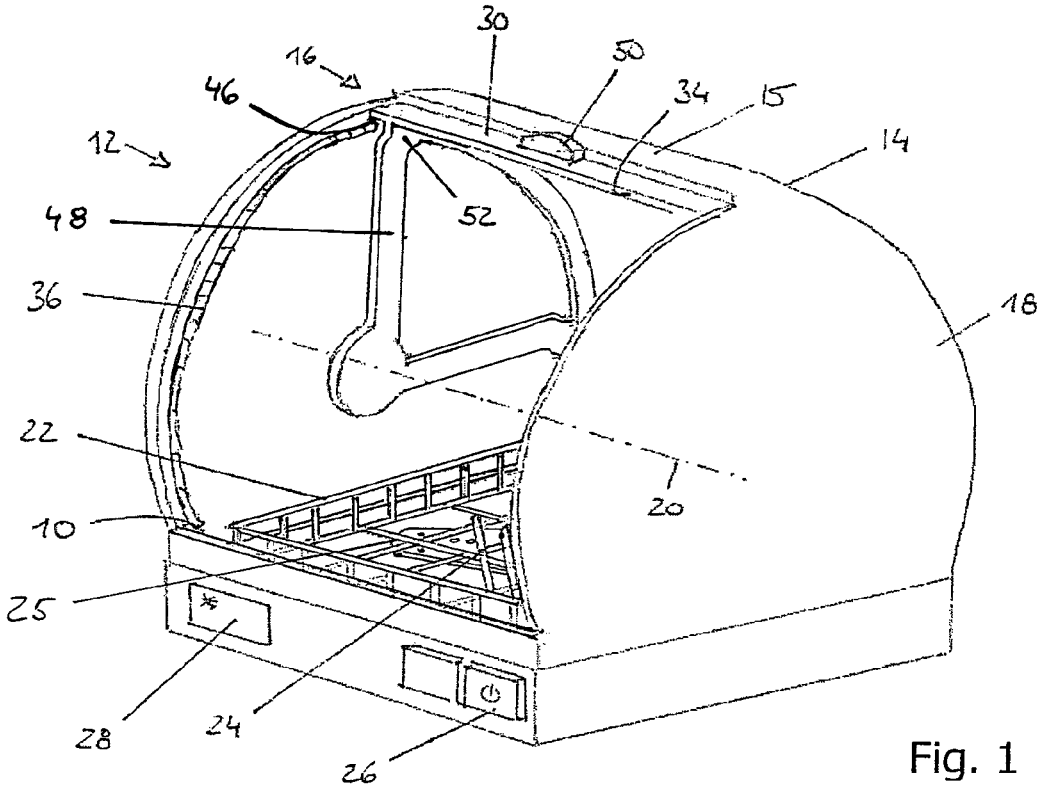
FIG. 1 is a perspective view of a table top dishwasher of the present invention.

FIG. 1 shows a table top dishwasher comprising a tub 10 and a cover member 12, which forms a hood over tub 10. Cover member or hood 12 is a generally cylindrical member comprising a fixed hood portion 14 and a rotatable door 16. Door 16 is rotatably supported at substantially semi-circular side portions 18 of the fixed hood portion so as to be pivotable about a horizontal axis 20. Within tub 10 there is provided a basket 22 which comprises a plurality of holders 24 for accommodating and fixing during a washing cycle a plurality of articles to be cleaned.

Within tub 10 there further are provided means for circulating cleaning liquid throughout the interior of the dishwasher, such as a spray arm 25 that is located below basket 22, and a circulation pump (not shown) and optionally a separate drain pump. In the lower portion of the dishwasher which comprises tub there further can be located any electrical components required for operation of the dishwasher, such as a power supply, a controller and the like, as well as operating switches 26 and a display 28.

As shown in FIG. 1, cover member 12 is a generally cylindrical or semi-cylindrical part, wherein approximately half of the arcuate surface shell is provided by the central region 15 of fixed hood portion 14 and the other half thereof is provided by central region 30 of door 16. Door 16 is rotatable about axis 20 between the open position shown in FIG. 1 and a closed position, wherein door 16 in FIG. 1 is rotated in a counter-clockwise direction until the lower edge 34 of door 16 contacts a respective sealing surface provided at tub 10.

Figure 2:
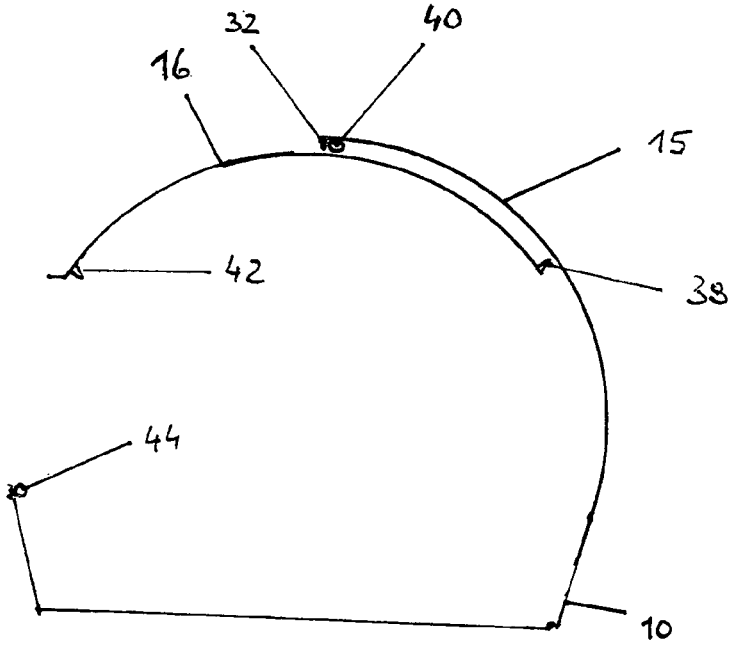
FIG. 2 is a schematic sectional view of the dishwasher of FIG. 1.

In particular, as shown schematically in FIG. 2, central region 15 of fixed hood portion 14 comprises a rim 32 which projects radially downwards into the gap between central region 15 and rotatable door 16. A top seal 40 extends along the rear side of rim 32 to engage a sealing surface which is provided at the rear or top edge of rotatable door 16 and which is formed by a rim 38 that projects radially outwards along the edge of door 16.

In order to provide for a sealing along the front or lower edge of door 16, a rim 42 extends along the lower edge 34 of rotatable door 12 at the interior side thereof, so as to provide for an abutment surface which upon closing door 16 engages a bottom seal 44 which extends along the upper front edge of washing tub 10.

In the embodiment shown in FIG. 1 door 16 further comprises a handle 50 which facilitates closing of the door and which at the same time provides for a stop which delimits rotation of door 16 at the fully opened position shown in FIG. 1.

In the embodiment shown in FIG. 1 side seals 36 extend in proximity to the front edge of the semi-circular side portions 18 of fixed hood portion 14. When rotatable door 16 is closed, door 16 contacts with its interior side the side seals 36, wherein the outermost regions of the interior side of door 16 thus forms abutment surfaces 46 for engagement of side seal 36. In order to make room for the provision of abutment surfaces 46, pivot arms 48 by which rotatable door 16 is pivotably hinged to be rotatable about axis 20 are provided with a bend portion 52 which contacts the inner face of door 16 at a distance from the lateral edge.

Whereas abutment surface 46 contacts side seal 36 with a certain predefined contact pressure when the door is closed, so as to prevent water from escaping from the interior of cover member 12 during a washing cycle, the geometries of side seal 36 and abutment surface 46 are selected such that the contact pressure between abutment surface 46 and side seal 36 is reduced when the door is opened. In the embodiment shown in FIG. 1 such reduction in contact pressure at side seal 36 is realized by providing for a side seal 36 having the shape of a circular arc in combination with a rotatable door 16, the curvature of which likewise is circular but wherein the pivot points of rotatable door 16 are upwardly offset with respect to the center of curvature of the side seals 36.

Figure 3:
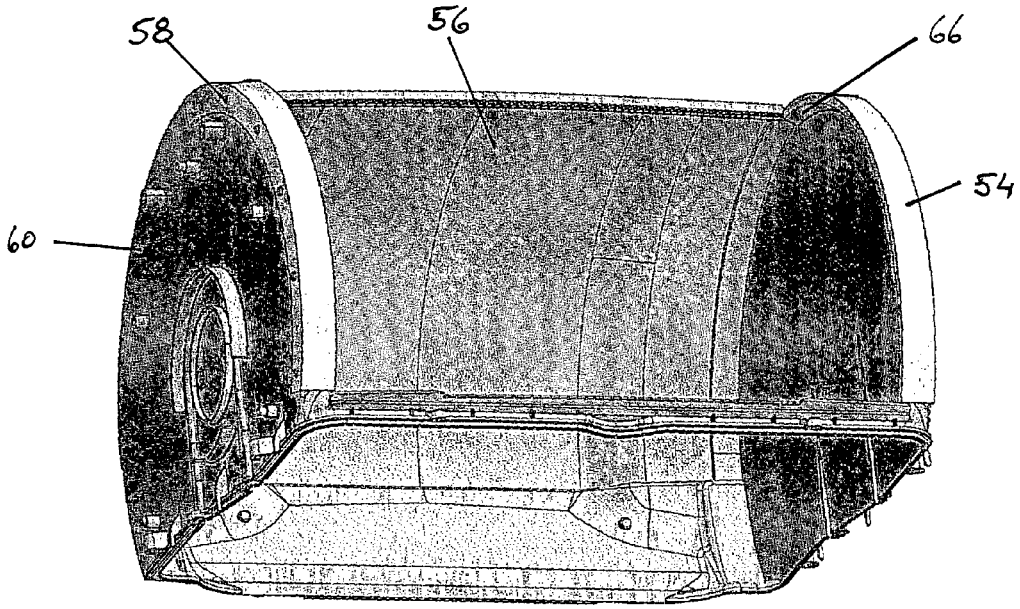
FIG. 3 is a perspective view of the fixed hood portion of a second embodiment of the table top dishwasher of the present invention.
Figure 4:
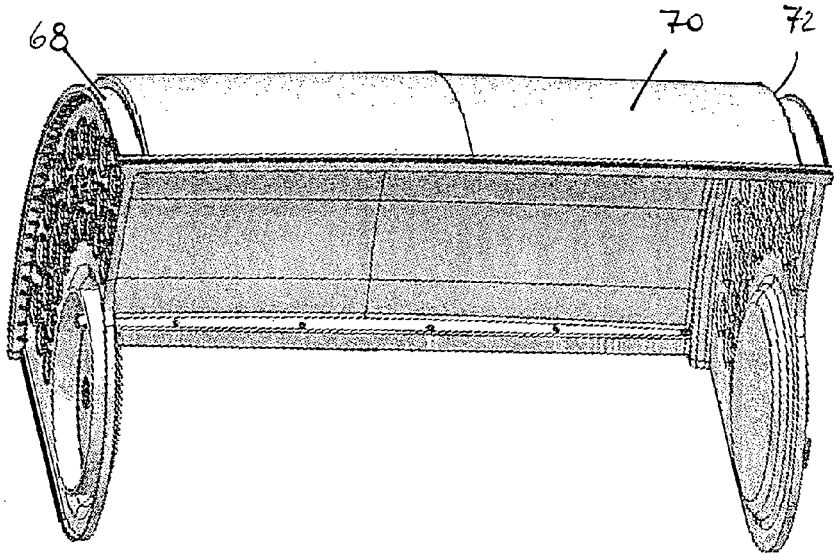
FIG. 4 is a perspective view of the door of the second of the present invention.
Figure 5:
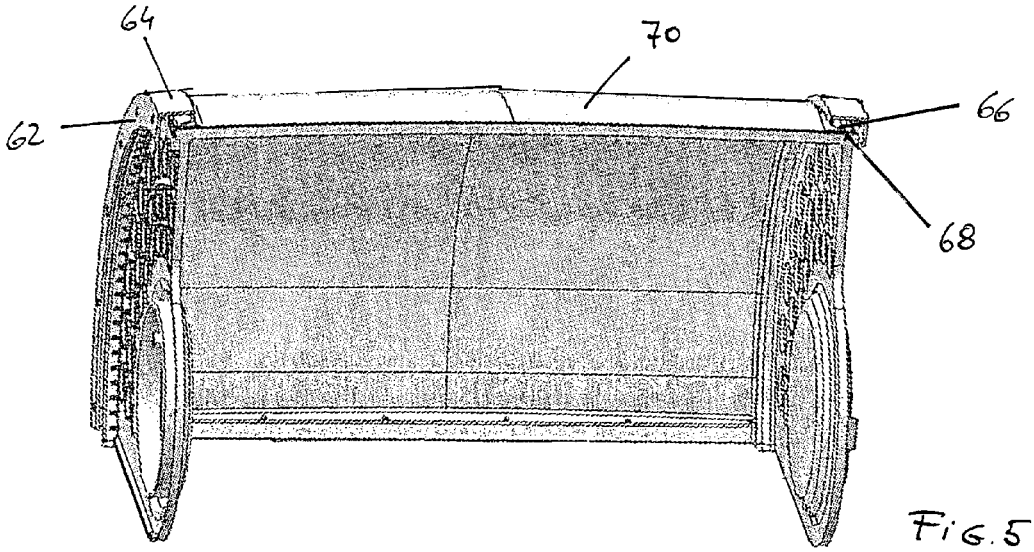
FIG. 5 is a perspective view of only the door and the side seal when the door is closed.
Figure 6:
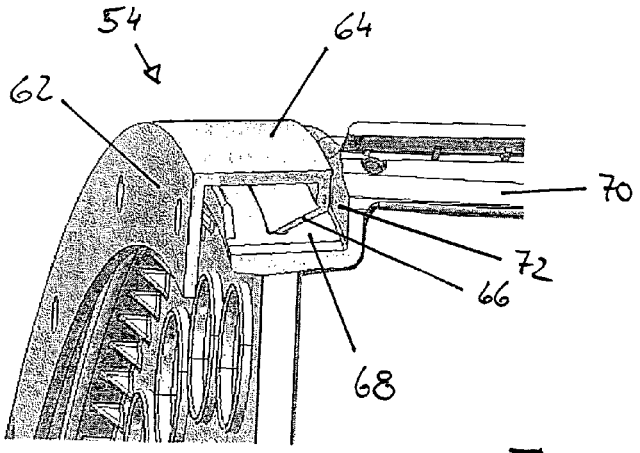
FIG. 6 shows the side seal of FIG. 5 in detail.

In FIGS. 3 to 6 elements of a second embodiment of a table top dishwasher are shown, which dishwasher differs from the first embodiment shown in FIG. 1 in that in the second embodiment the side seals contact abutment surfaces that are provided at the exterior side of the generally cylindrical face of the rotatable door. As shown in FIG. 3, side seals 54 are provided along the front lateral edges of the side regions 60 of the fixed hood portion 56. As can be seen in FIG. 5 and particularly in the enlarged illustration of FIG. 6, side seals 54 have a substantially rectangular cross-section and comprise a first leg 62 which extends in parallel to the side regions 60 of the fixed hood portion and a second leg 64 which projects in the axial direction of the cylindrical shape of the fixed hood portion. First leg 62 comprises a plurality of fixing points 58 where the side seal 54 is attached to the side region 60 of the fixed hood portion 56. A sealing lip 66 extends from the free end of the second leg 64 towards the axis of fixed hood portion 56 so as to contact from above an abutment surface 68 that is provided at the exterior side of rotatable door 70. As can be seen in FIG. 4 but also in the detailed view of FIG. 6, abutment surface 68 is provided in a recess 72 which extends along the lateral edge of rotatable door 70. Hence, if during use of the dishwasher water enters the gap between side seal 64 and abutment surface 68 of the door 70, any such water will be guided along recess 72 back into the tub 10.

Figure 7:
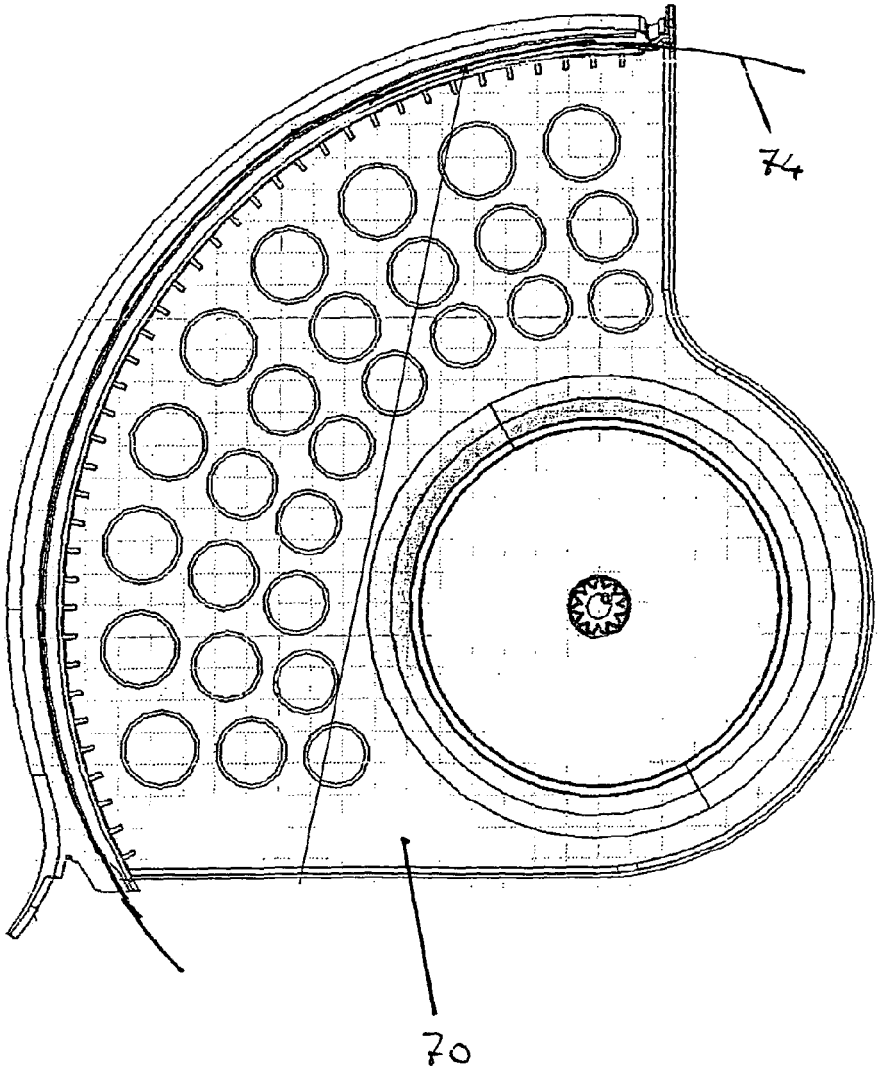
FIG. 7 is a side view of the door shown in FIGS. 4 and 5.

FIG. 7 is a side view of door 70 shown in FIGS. 4 and 5. Whereas in the second embodiment the side seals 64 have a circular shape, the abutment surfaces 68 of the rotatable door 70 are slightly non-circular. In particular, as can be seen in FIG. 7, the radius of curvature of the abutment surfaces 68 gradually increases from the lower edge of door 70 towards its upper edge. Thus, when considering the circular reference line 74 shown in FIG. 7, it is to be seen that the abutment surface 68 is closer to such reference line at the lower edge of the door and is further away from reference line 74 towards the upper edge of the door.

Furthermore, in the embodiment shown in FIGS. 3 to 7, the center of curvature of the side seals 54 is offset with respect to the pivot points of the rotatable door, so that the contact pressure between sealing lip 66 and abutment surface 68 is reduced when the rotatable door is opened. In this manner, excessive wear of the sealing lip 66 is effectively prevented.

REFERENCE SIGNS

10 tub
12 cover member
14 fixed hood portion
15 central region of 14
16 rotatable door
18 side portion
20 horizontal axis
22 basket
24 holder
25 spray arm
26 operating switch
28 display
30 central region of 16
32 rim at 15
34 lower edge of 16
36 side seal
38 rim at rear edge of 16
40 top seal
42 rim at front edge of 16
44 bottom seal
46 abutment surface
48 arm
50 handle
52 bend in 48
54 side seal
56 fixed hood portion
58 fixation
60 side region
62 $1^{st}$ leg of 54
64 $2^{nd}$ leg of 54
66 sealing lip
68 abutment surface
70 rotatable door
72 recess
74 circular reference line

The invention claimed is:

1. A table top dishwasher, comprising:

(a) a tub for accommodating articles to be cleaned; and (b) a water-tight hood located above said tub, said hood comprising two fixed side portions, and a curved central region having generally the shape of a cylinder shell the axis of which extends horizontally and a lower section of which has been cut away so as to merge into the upper edge of the tub; said central region comprising a fixed portion which is joined to said side portions and a door which is rotatably connected to the side portions, the door being rotatable between a closed position in which it forms part of the cylinder shell, and an opened position in which the door at least in part superposes the fixed portion, said hood further comprising a sealing arrangement for said door, the sealing arrangement comprising curved side seals and curved abutment surfaces extending continuously along the lateral edges of the door, wherein when the door is closed a contact pressure is exerted between the side seal and the abutment surfaces in a direction perpendicular to the axis of rotation of the door, wherein the radius of curvature of the side seals substantially corresponds to the radius of curvature of the abutment surfaces, and wherein the center of curvature of the side seals is offset with respect to the center of curvature of the abutment surfaces to facilitate the contact pressure when the door is closed, wherein when the door is opened the contact pressure is substantially reduced or terminated.

2. The dishwasher of claim 1, wherein the center of curvature of the side seals and the center of curvature of the abutment surfaces are offset both in the vertical direction and in the horizontal direction.

3. The dishwasher of claim 1, wherein the center of curvature of the side seals and the center of curvature of the abutment surfaces are located at substantially the same vertical position but are offset in the horizontal direction.

4. The dishwasher of claim 1, wherein the center of curvature of the side seals is offset with respect to the center of curvature of the abutment surfaces by a distance of 2 to 10 mm.

5. The dishwasher of claim 1, wherein the curvature of the side seals and/or the abutment surfaces is non-circular.

6. The dishwasher of claim 5, wherein the curvature of the side seals and/or of the abutment surfaces gradually increases over its length.

7. The dishwasher of claim 1, wherein the door in its opened position is located below the fixed portion.

8. The dishwasher of claim 1, wherein said side seals are attached to the fixed side portions of the hood.

9. The dishwasher of claim 1, wherein said abutment surfaces are provided at an exterior side of the door.

10. The dishwasher of claim 9, wherein the door comprises a stepped recess which extends along the lateral edge of the door, wherein a floor of the recess constitutes the abutment surface.

11. The dishwasher of claim 9, wherein the side seals are substantially circular and wherein the radius of curvature of the abutment surfaces of the door increases from the lower edge of the door towards the upper edge of the door.

12. The dishwasher of claim 1, in which said fixed portion of the central region of the hood spans about half of the circumference of the hood.

13. The dishwasher of claim 1, wherein a top seal is provided at one of the front edge of said fixed portion and the top edge of said door, wherein the other one of said front edge and said top edge comprises a top seal abutment surface extending between the fixed portion and the door.

14. The dishwasher of claim 1, wherein a bottom seal is provided at one of the upper edge of said tub and the bottom edge of said door, and the other one of said upper edge and said bottom edge comprises a bottom seal abutment surface extending between the tub and the door.

* * * * *